US005647596A

United States Patent [19]

Rail

[11] Patent Number: 5,647,596

[45] Date of Patent: Jul. 15, 1997

[54] TARGET SYSTEM

[76] Inventor: Robert R. Rail, 1786 English Dr., Glendale Heights, Ill. 60139

[21] Appl. No.: 317,488

[22] Filed: Oct. 4, 1994

[51] Int. Cl.[6] ..... F41J 5/00

[52] U.S. Cl. ..... 273/383; 273/374; 273/378; 273/386

[58] Field of Search ..... 273/403, 380, 273/383, 384, 385, 389, 387, 393

[56] References Cited

U.S. PATENT DOCUMENTS

| | | | |
|---|---|---|---|
| 683,503 | 10/1901 | Schloerb | 273/385 |
| 2,059,918 | 11/1936 | Straka | 273/383 |
| 2,636,739 | 4/1953 | Preston | 273/385 |

FOREIGN PATENT DOCUMENTS

| | | | |
|---|---|---|---|
| 785557 | 8/1935 | France | 273/383 |

*Primary Examiner*—Vincent Millin
*Assistant Examiner*—Charles W. Anderson
*Attorney, Agent, or Firm*—Olson & Hierl, Ltd.

[57] ABSTRACT

The invention relates to a target system including a target deck, trigger board and target plate. Apertures are provided in both the target deck and trigger board. The target deck is configured to receive or be juxtaposed to the trigger board so that the apertures are generally aligned. The target plate is shaped to fit within the generally aligned apertures. When the target plate is displaced from the aperture of the trigger board, the target deck moves to signify that the target plate has been struck. Another embodiment contemplates mounting the target plate to the target deck. A resistance device may also be added to prevent non-predetermined projectiles from displacing the target plate from the apertures.

30 Claims, 4 Drawing Sheets

TARGET SYSTEM

FIELD OF THE INVENTION

The present invention relates to a target for projectiles and, more particularly, a target that signifies it has been accurately hit.

BACKGROUND OF THE INVENTION

Firearms are used in law enforcement and the military. Such use requires accurate shooting by a firearm user. To aid in achieving accuracy, target ranges are usually used by individuals to train or practice. Typical target ranges place a paper target, supported in some conventional fashion, a distance from the firearm user to promote accurate shooting. The firearm is aimed at markings usually on the target, and projectiles, such as bullets, from the firearm simply pass through the paper target.

However, law enforcement officers and military personnel encounter situations that also involve reactive shooting. Reactive shooting requires quick judgment and reaction, as well as accurate shooting. To teach such reactive shooting, some target ranges include reactive targets that, unlike the paper target mentioned above, signify to the firearm user that they have been hit. Such reactive targets may be spun around an axis or knocked down to signify that they were hit. Target ranges equipped with these reactive targets can simulate some situations that firearm users may encounter.

A deficiency of the paper target described above is that the firearm user has to see the bullet holes in the paper to detect if it has been accurately hit. This is impossible if the target is at a distance where the holes cannot be seen. Thus, the firearm user may not know if the target has been hit at all. Consequently, no instant response is provided to the user that is necessary for reactive and accurate shooting training.

The spin or knockdown targets react when struck even in unintended areas. Thus, the firearm user will not know if an intended area was hit. As a result, accurate shooting will not be enhanced.

Target apparatus are disclosed in U.S. Pat. No. 194,614 to Charles Oakford entitled "TOY TARGETS," U.S. Pat. No. 683,503 to Henry Schloerb entitled "TARGET," U.S. Pat. No. 1,268,115 to George T. Haines and Burton W. Smith entitled "TOY," U.S. Pat. No. 1,378,340 to Clifford J. Fairchild entitled "TARGET," and U.S. Pat. No. 2,039,782 to Howard R. Doty entitled "GAME APPARATUS."

U.S. Pat. Nos. 194,614 and 683,503 disclose target apparatus having boards with openings where bull's-eyes or discs are placed. Attached to the back of the bull's-eyes are rods. The rods are also attached to figures that pop up from behind and over the target board when the bull's-eyes are struck and forced out of the openings. Elastic materials associated with the rods provide the force to pop up the figures.

One disadvantage of the targets disclosed in these patents is that the rod limits the axial movement of the bull's-eye with respect to the opening. This limited axial movement causes the bull's-eye to impede the path of projectiles through the opening. Not only would the projectiles damage the bull's-eye so that repeated use would not be possible, but the mechanisms for popping up the figures would also be damaged. In addition, these mechanisms require numerous extra components to manufacture the target apparatus and depend on proper alignment of these components to function properly. Also, the elastic material loses its elasticity over time.

Furthermore, the figures which pop up have only a small area compared with the entire area of the target board. The figures may be hard to notice by the firearm user from afar after the bull's-eyes are hit. And, the mechanisms for popping up the figures increase the cost of manufacturing and reduce the reliability and reusability of these targets.

U.S. Pat. Nos. 1,268,115, 1,378,340 and 2,039,782 disclose target apparatus where disks are maintained visibly behind openings in the front of the target apparatus. In the U.S. Pat. No. 1,378,340, the disk is struck and shatters. The other two patents disclose a projectile knocking the disk out from their maintained position.

A disadvantage of these three described patents is that there is no physically exaggerated feedback to signify to the firearm user that the intended area on the target apparatus has been hit. In the U.S. Pat. No. 2,039,782, the opening in the target apparatus is left unobstructed once the disc is shot out. The unobstructed opening may not be seen by the firearm user from a distance since the area of the opening is small compared with the entire target apparatus. Additionally, the shattered disk is not reusable once it has been shot. In the other two patents, another disk replaces the shot disc. Thus, the firearm user may not know if the disc was hit. Eventually, the disks run out and the openings in the target apparatus are also left unobstructed. The unobstructed openings are especially hard to detect when the target apparatus is located a distance from the firearm user because the areas of the openings are also small relative to the entire target apparatus. Further, the structure of the U.S. Pat. No. 1,268,115 may be damaged by a projectile, such as a bullet.

Another disadvantage of the above-discussed patents is that the firearm user cannot reset the target while distant from the target.

Accordingly, there is a need for a target that will provide not only accurate shooting training, but also reactive shooting training. The target should have a simple mechanical design that allows for ease of use, reliability and reusability, yet maintain compatibility for use in existing target ranges and reduce manufacturing costs. It should also provide instant physically exaggerated feedback to firearm users that the target has been hit in the intended area, and such feedback should be visible at distances from firearm users. A further provision of such a target system would be resetability from a distance to the target system. Such a target system will provide increased confidence, realistic combative skill training, focused target selection, judgmental practice and decreased liability through realistic training. As a natural result, an acquired skills response will be achieved. The present invention meets these needs.

SUMMARY OF THE INVENTION

The present invention relates to a target system including a trigger board, target deck and target plate. Both the trigger board and target deck include at least one aperture. When the target system is in its operative configuration, the trigger board and target deck are disposed in a preferably fixed, overlapped or juxtaposed relationship with their respective apertures generally aligned with each other. The target plate then removably fits within the generally aligned apertures to maintain the trigger board and target deck in the fixed relationship.

In the preferred embodiment of the present invention, the target deck has a preferred rectangular configuration. The configuration has front and back surfaces. Top, bottom and side regions are defined between the periphery of the front and back surfaces. An aperture, preferably circular, is located in the midsection of and transversely through the front and back surfaces. The location of the aperture is not limited by the present invention to the midsection of the front and back surfaces. Additionally, more than one aperture can be provided in the same surfaces or in opposing regions. Other configurations may be used for the target deck or trigger board, such as a silhouette of a human, as required by the user.

A guide, preferably a rectangular slot, is longitudinally located in the target deck. The slot is formed through the top surface and extends longitudinally into the target deck. The slot may longitudinally extend through the entire target deck and the bottom region. The trigger board is preferably rectangular in shape to be slidingly receivable within the target deck slot. The trigger board also preferably has a circular aperture that is alignable with the target deck aperture when the trigger board is received in the target deck slot.

The present invention can also use other guides instead of the slot provided in the target deck. For example, the target deck may be provided as a plate with an aperture. Guide channels may be located on opposing edges of one side of the target deck. The trigger board may then be slidingly received in the channels alongside or juxtaposed to the target deck so that their respective apertures may be aligned. The channels may be integral with the target deck.

The target plate may be of any shape, but a generally circular shape is preferred. Also, if more that one target plate is used in the target system, the target plates may have the same or different shapes with respect to each other or the apertures. It is also preferred that the target plate be reusable.

The present invention envisions the apertures and the target plate are shaped so that the target plate will removably fit within both apertures when the apertures are generally aligned. It is preferred that the apertures in the trigger board and target deck have generally the same shape and shape dimensions as each other and the target plate. However, different shapes or shape dimensions may be used for the apertures with respect to each other and the target plate.

The trigger board is preferably connected to any conventional range target holder clamp or support. Alternatively, the target deck may be attached to a support. The present invention may be suspended from or supported by the clamp, or may be supported by a stand.

When assembling the target system in its operative state, the trigger board is received within the target deck slot so that the apertures are generally aligned. The target plate is removably fit within the apertures so aligned. When the target plate is struck by a projectile, it is knocked out of at least one aperture. The projectile may be deflected by the target plate or may penetrate the target plate, possibly through the target plate if desired. In response, the target deck will move with respect to the clamped trigger board to signify an accurate hit. The target deck moves because a force, such as gravity, is acting upon it when the target plate is displaced from at least one of the apertures. The target system may be configured so that, when the target plate is displaced from at least one aperture, the target deck slides either completely or partially off the trigger board.

The edges of the target plate may be preferably tapered conically to facilitate the displacement or removability of the target plate from the fit within the generally aligned apertures. The target plate may also include an enlarged backing to facilitate the target plate being placed within the generally aligned apertures.

Another embodiment of the present invention includes an attachment device, such as a hinge or tape, to connect the target plate to the target deck or the trigger board. The attachment device is preferably connected to the target plate in such a fashion to allow the target plate to be displaced from at least one of the apertures, but remain connected to the target deck or trigger board.

The present invention may also include a resistance device that offers resistance to the projectile upon impact with the target plate so that the target plate will be dislodged from at least one of the apertures only if the projectile is of a predetermined type, such as a large caliber bullet.

The present invention may also be configured to be reset in its operative state by a user located a distance from the target system. A cord, preferably a filament, is attached to the target deck. The cord is associated with the trigger board so that when the user pulls the cord, it resets the target system by aligning the apertures such that the target plate, which is attached to the target deck, is refitted into the aligned aperture.

Various materials may be used for the target system. Each component of the system may be made with the same material or different materials. These materials include, but are not limited to, cardboard, plain or coated, solid or corrugated; metal; plastic, semi-soft or rigid; styrofoam and wood. The target plate may also be made of multilayered, waxed or laminated cardboard, and a filler may be added to the cardboard. Such filler includes, but is not limited to, KEVLAR™, felt, cotton, leather, cloth, vinyl, wax, extruded plastic or metal, and stuffed cloth. The filler may alternatively be applied to the exterior of the target plate.

A paper target may be used with the target system of the present invention. The paper target may be placed over the target system, preferably the target deck, and preferably designates an area to be hit by the projectile. Preferably, the designated area coincides with a target plate located beneath it.

DETAILED DESCRIPTION OF THE PREFERRED EMBODIMENT

Figure 1:
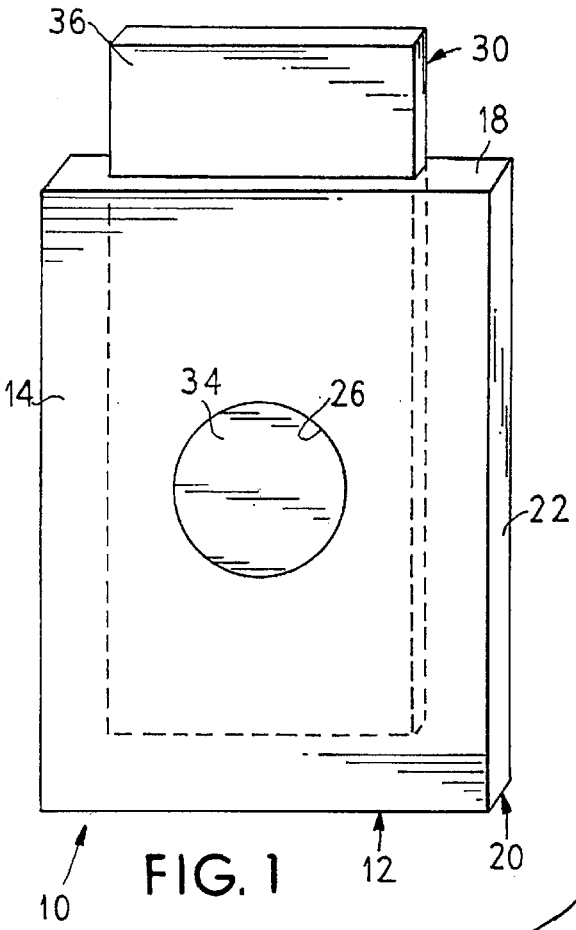
FIG. 1 is a perspective view of one embodiment of a target system in accordance with the present invention.

Referring to FIG. 1, a target system in accordance with the present invention is designated generally by the reference number 10. The target system 10 includes a target deck 12 having a rectangular configuration and illustrated in the form of a generally flat rectangular block including and partially defined by generally planar parallel opposed spaced surfaces 14 and 16. The rectangular block also includes and is partially defined by top and bottom regions or surfaces 18 and 20, and side regions or surfaces 22 and 24 that are also preferably generally planar, parallel, opposed and spaced, respectively.

Figure 2:
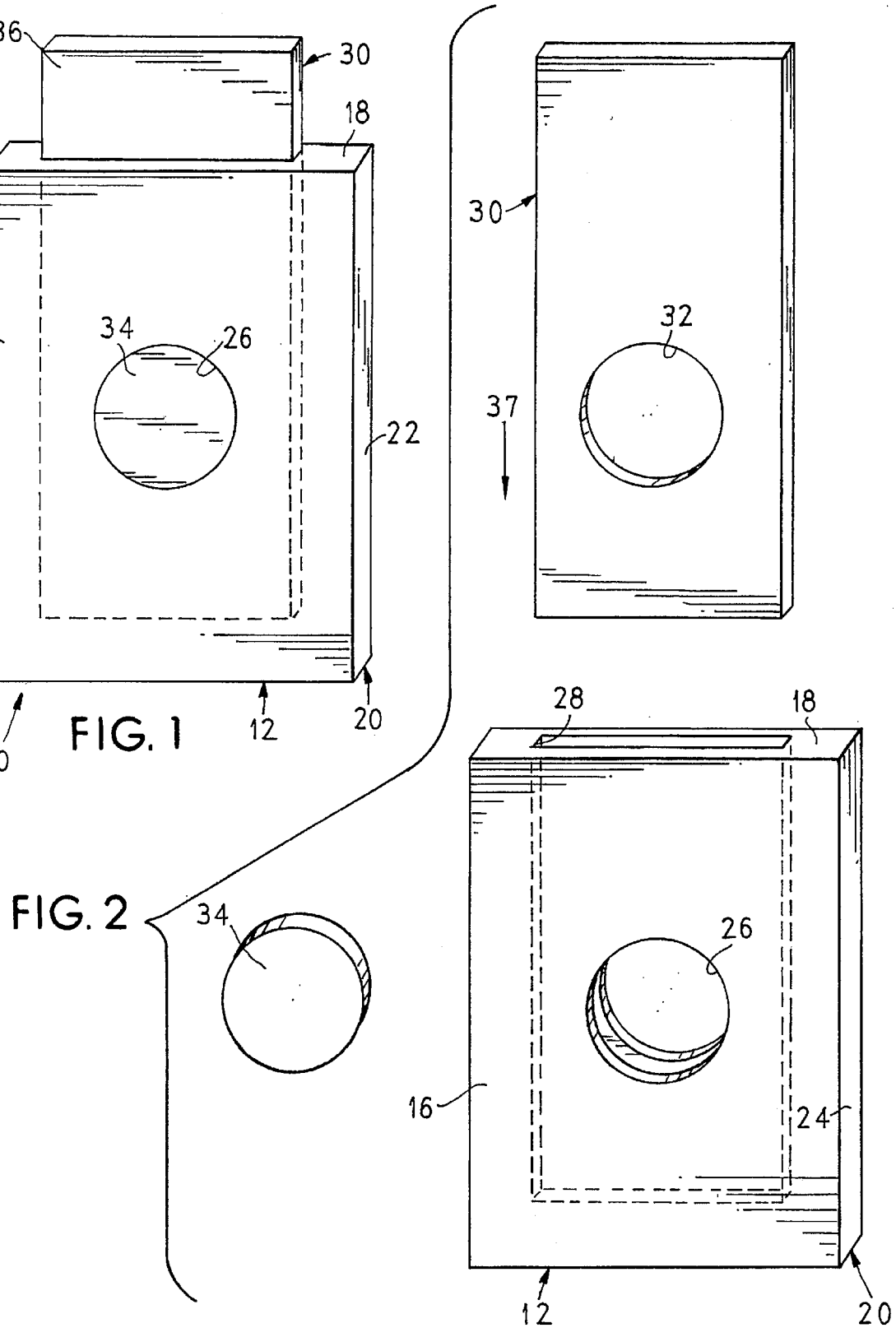
FIG. 2 is an exploded rear perspective view of the FIG. 1 embodiment.

As illustrated in FIG. 2, a preferably circular aperture 26 is generally located in the midsection of the target deck 12, transversely through the surfaces 14 and 16. A rectangular slot 28 extends longitudinally within the target deck 12 through the top surface 18. The slat 28 may extend through the bottom surface 20.

As seen in FIGS. 1 and 2, a trigger board 30 is provided as a generally flat rectangular plate slidably receivable in the slot 28. A preferred circular aperture 32 preferably having the same diameter as the aperture 26 is located in the midsection of the trigger board 30. A target plate 34 is provided as a preferred circular disc as depicted in FIG. 2. It is preferred that the diameter of the target plate 34 allows it to have a removable fit, possibly frictional, in at least one of the apertures 26 and 32.

Alternatively, the apertures 26 and 32 may have different diameters. For example, the aperture 26 may have a diameter greater than the diameter of the aperture 32. When the trigger board 30 is slid into the slot 28 of the target deck 12, the larger diameter of the aperture 26 will facilitate the placement of the target plate 34 since the alignment of the apertures 26 and 32 is less critical. Providing apertures with different diameters can relax the manufacturing tolerances of the target system 10.

As another alternative, the target plate 34 can have a diameter less than the diameters of apertures 26 and 32. In this alternative, the lesser diameter of target plate 34 facilitates its placement in the apertures 26 and 32 since the alignment of the apertures 26 and 32 is less critical. This alternative can also relax the manufacturing tolerances of the target system 10.

Referring to FIG. 1, the target system 10 is shown in its operative configuration. The trigger board 30 is slidably received in the slot 28 of the target deck 12. The apertures 26 and 32 are generally aligned so that the target plate 34 can be simultaneously fit within both apertures to maintain the trigger board 30 in a fixed, preferably overlapping, relationship to the target deck 12. Also shown in FIG. 1, the trigger board 30 has a portion 36 that extends from the target deck 12 a predetermined distance. The portion 36 may be connected to any conventional range target holder clamp or support.

Turning to FIG. 2, once the target plate 34 is displaced from the aperture 32 by a projectile, the trigger board 30 and the target deck 12 are no longer maintained in a fixed relationship. As a consequence, the target deck 12 slides off the trigger board 30 in the direction of the arrow 37 to signify that the target plate 34 has been hit.

As an alternate orientation, the target system 10 shown in FIG. 1 may be reciprocated so that the target deck 12 is connected in the general area of the bottom surface 20 to a range clamp or support. When the target plate 34 is displaced from the aperture 32 by a projectile, the trigger board 30 and the target deck 12 are no longer maintained in a fixed relationship. The trigger board 30 slides out from the slot 28 of the target deck 12 to signify that the target plate 34 has been hit.

An alternate embodiment includes a target system similar to the target system 10 illustrated in FIG. 1, which may be reciprocated such that the portion 36 is connected to a stand. The slot 28 in the target deck 12 should extend through the bottom surface 20. Once the target plate 34 is displaced from the aperture 32 by a projectile, the trigger board 30 and the target deck 12 are no longer maintained in a fixed relationship. The target deck 12 will slide down the trigger board 30 to signify that the target plate 34 has been accurately struck.

This alternate embodiment may be reciprocated such that the target deck 12 is connected to a range stand in the general area of bottom surface 20. After the target plate 34 is displaced from the aperture 32 by a projectile, the trigger board 30 and the target deck 12 are no longer maintained in a fixed relationship. The trigger board 30 slides through the slot 28 and the bottom surface 20 to signify that the target plate 34 has been accurately struck. The range stand preferably does not block the trigger board 30 as it moves through the bottom surface 20.

Figure 3:
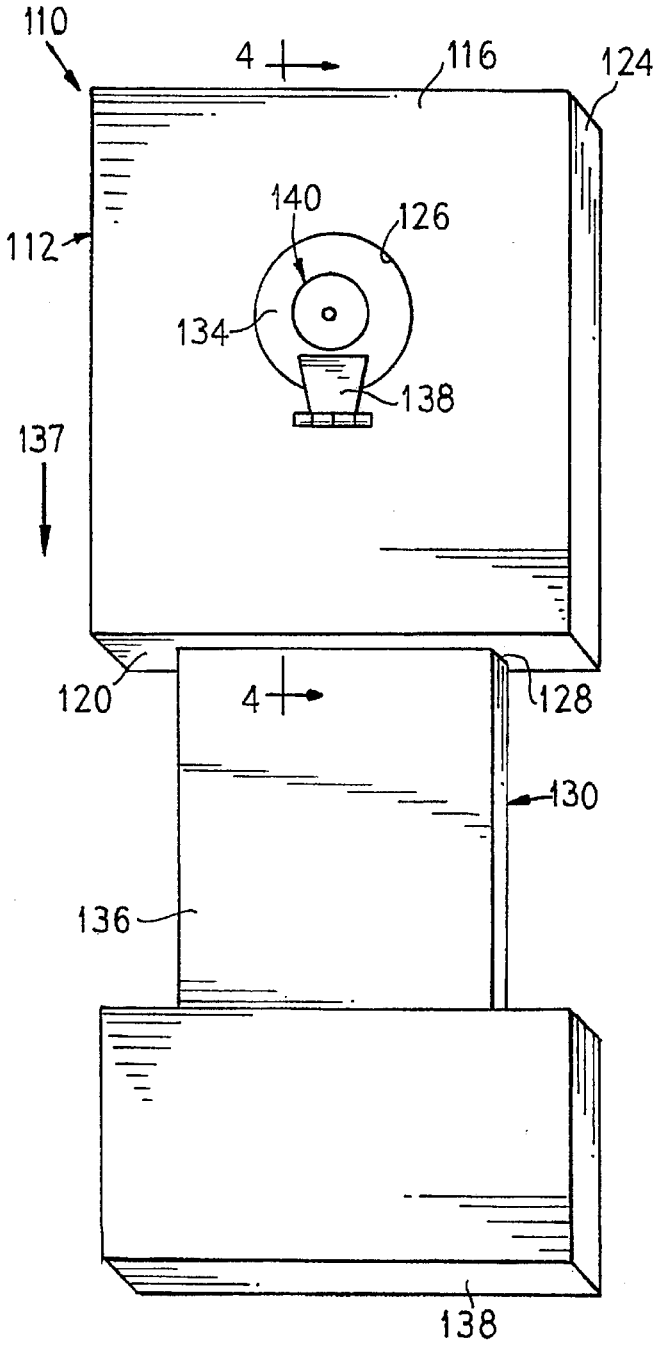
FIG. 3 is a rear perspective view of another embodiment of the present invention.
Figure 4:
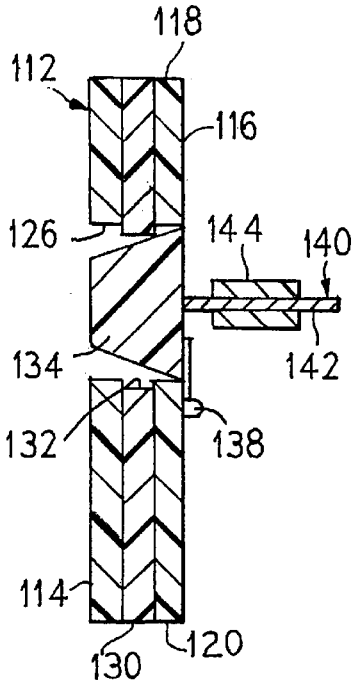
FIG. 4 is a cross-sectional view of the FIG. 3 embodiment in an operative configuration taken along plane 4—4.

Referring to FIG. 3, another embodiment of a target system according to the present invention is shown as 110. The target system 110 includes a target deck 112 in the preferred form of a generally flat rectangular block including generally planar parallel opposed spaced surfaces 114 and 116 (FIG. 4). The rectangular block also includes top and bottom surfaces 118 and 120 (FIG. 4), and side surfaces that are also preferably generally planar, parallel, opposed and spaced, respectively, one of which is referenced as 124 in FIG. 3.

As illustrated in FIG. 3, a preferably circular aperture 126 is generally located in the midsection of the target deck 112, transversely through the surfaces 114 and 116. A rectangular slot 128 extends longitudinally within the target deck 112 through the bottom surface 120. The slot 128 may extend through the top surface 118.

As seen in FIG. 3, a trigger board 130 is provided as a generally flat rectangular plate slidably receivable in the slot 128. The trigger board 130 includes a preferred circular aperture 132 (FIG. 4) preferably having the same diameter as the aperture 126. A target plate 134 is provided as a preferred circular disc as depicted in FIG. 3. It is preferred that the target plate 134 is conically shaped (FIG. 4) and has a diameter so that it can be fit into the apertures 126 and 132.

Further illustrated in FIG. 3, the target plate 134 is pivotally connected to the surface 116 of the target deck 112 by an attachment device, such as a hinge 138. The hinge 138 maintains the target plate 134 connected to the surface 116 of the target deck 112 after being displaced from the apertures 126 and 132. Also, shown is a resistance device 140 connected to the target plate 134. The resistance device 140 includes a shaft 142 that is preferably connected normal to the target plate 134 as seen in FIG. 4. A weight 144, also seen in FIG. 4, is associated with the shaft 142 to provide resistance to a projectile that strikes the target plate 134.

The target system 110 shown in FIG. 3 is in its operative configuration. The trigger board 130 is slidably receivable in the slot 128 of the target deck 112. The apertures 126 and 132 are generally aligned so that the target plate 134 can be fit within both apertures to maintain the trigger board 130 in a fixed relationship to the target deck 112.

The trigger board 130 may also include a portion 136 that extends from the target deck 112 a predetermined distance. Connected to the portion 136 is a stand 146 to support the target system 110 in an upright position. Alternatively, the portion 136 may be connected to any conventional range target holder damp or other support.

With reference to FIG. 4, the target plate 134 is operatively fitted into the apertures 126 and 132 to position the trigger board 130 and the target deck 112 in a fixed relationship. The resistance device 140 helps maintain the target plate 134 in the apertures 126 and 132 when a nonpredetermined projectile strikes the target plate 134.

Figure 5:
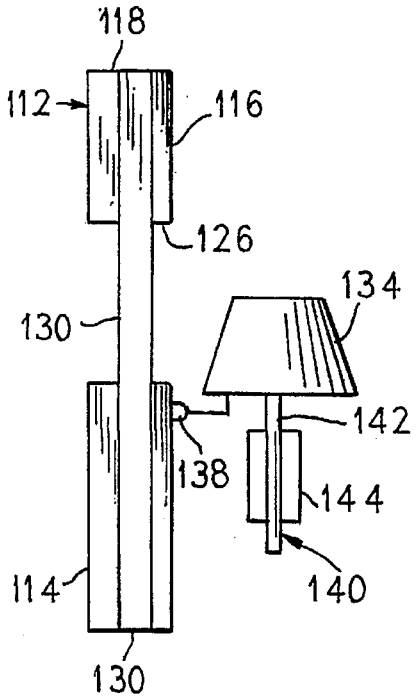
FIG. 5 is a perspective view similar to FIG. 4 showing a postfiring configuration.

Exhibited in FIG. 5 is the target system 110 in a postfiring configuration. The target plate 134 has been displaced from the apertures 126 and 132 by a projectile. However, the target plate 134 remains connected to the target deck 112 by the hinge 138. Pivoting the target plate 134 with the hinge 138 allows the target plate 134 to be displaced from the path of the projectile, yet still be connected to the target deck 112 for easy refitting into the apertures 126 and 132.

Once the target plate 134 is displaced from the aperture 132, the target deck 112 moves in the direction shown by the arrow 137 in FIG. 3 to indicate that the target plate 134 has been successfully struck.

To reconfigure the target system 110 into an operative state, the target deck 112 need only be moved in the opposite direction of the arrow 137 in FIG. 3 to generally align the apertures 126 and 132 so that the target plate 134 may be placed within the aligned apertures.

Figure 6:
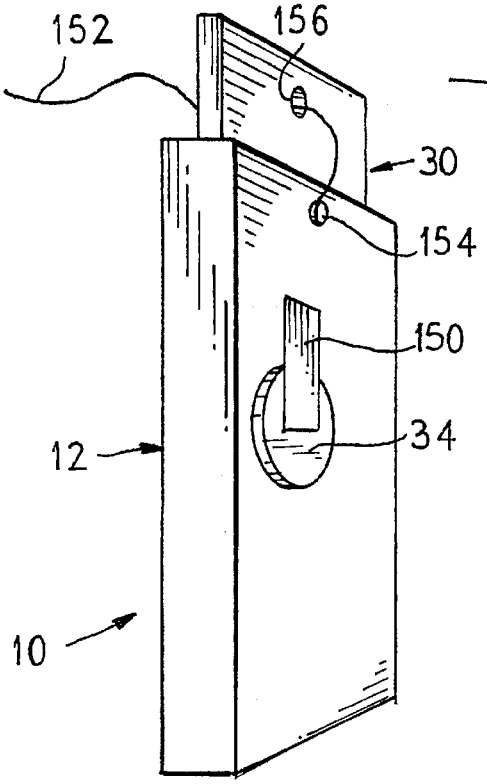
FIGS. 6–8 show perspective views of a modification to the FIG. 3 embodiment in different states of operation.

Illustrated in FIG. 6 is a modification to the FIG. 1 embodiment. Specifically, target plate 34 is attached to target deck 12 by another attachment device 150, such as tape or a hinge. A cord 152, such as a filament, is attached to the target deck by a fastener 154. The cord 152 is preferably passed through an aperture 156 located transversely in trigger board 30.

Figure 7:
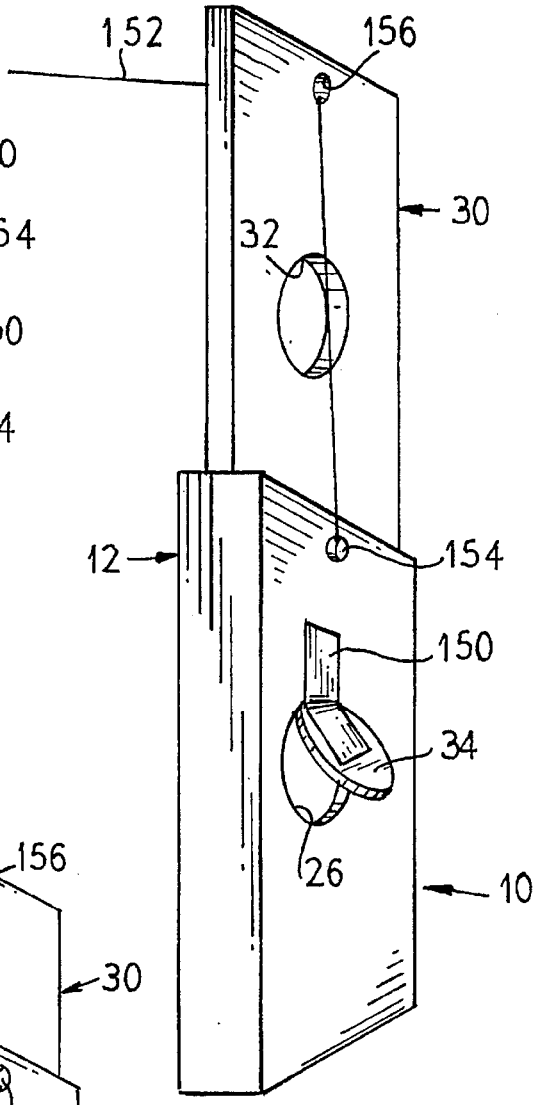

As shown in FIG. 7, the target plate 34 has been successfully struck by a projectile, which dislodged the target plate 34 from the apertures 26 and 32. The target deck 12 slides down trigger board 30. The target deck 12 is prevented from sliding entirely off the trigger board 30 by a stop configuration associated with the target deck 12 and trigger board 30. The stop configuration can be the cord 152 as shown, which has a length that prevents the target deck from sliding completely off the trigger board 30 as shown in FIG. 7. Alternatively, the stop configuration can be a catch arrangement such as a stud and slot carried cooperatively by the plate 34 and deck 12.

Figure 8:
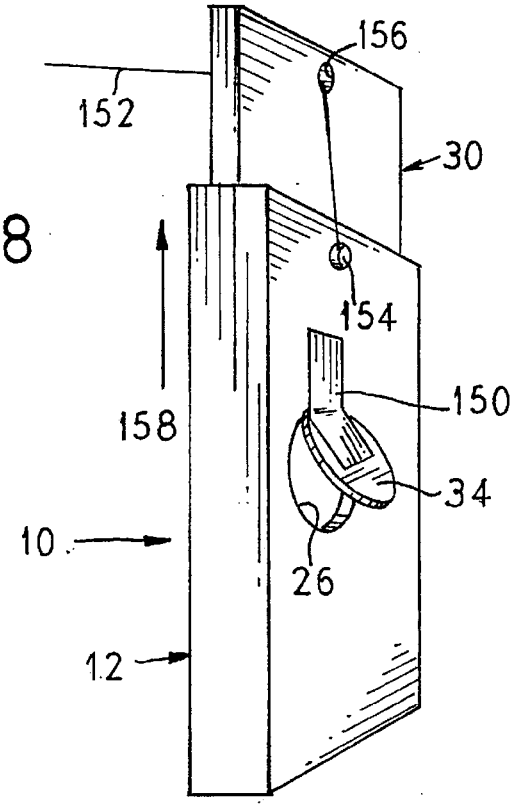

FIG. 8 exemplifies how the cord 152 resets or reconfigures the target system 10. The firearm user pulls on the cord 152. The cord 152 applies a force to the target deck 12 through the fastener 154. In response, the target deck 12 is moved in the direction of an arrow 158. Once the apertures 26 and 32 are generally aligned, the target plate 34 is refitted by gravity within those apertures.

In the FIG. 8 embodiment, a force such as gravity acts upon the mass of the target plate 34 to refit it within the apertures 26 and 32. Alternatively, the attachment device may exert a force on the target plate 34 to refit it within the apertures 26 and 32 once those apertures are generally aligned. If desired, a spring loaded hinge can also be used.

Figure 9:
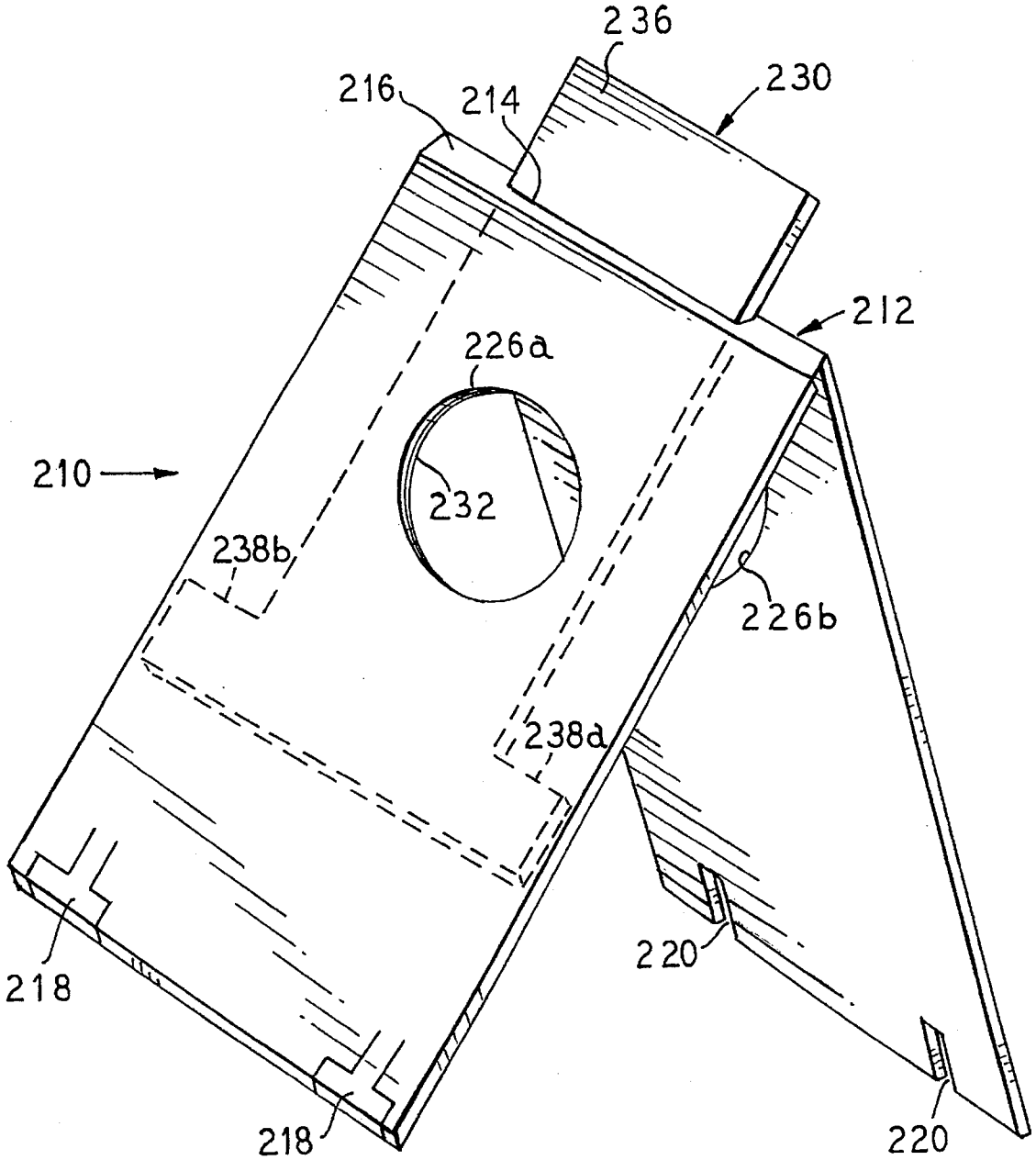
FIG. 9 is a perspective view of a further embodiment of the present invention in a semi-folded configuration.

A third embodiment is illustrated in FIG. 9. A target system 210 includes a target deck 212. The target deck 212 is preferably cardboard die cut to a desired configuration. An aperture 214 is located in a portion 216 of the target deck 212 to receive a trigger board 230.

The target deck 212 folds upon itself to preferably define an area, such as a slot or other guide, in which the trigger board 230 is slidably receivable. Punch-out pivot tabs 218 and slots 220 are preferably die cut into the target deck such that the tabs 218 pivot to engage or be received in slots 220 to maintain target deck 212 in a folded configuration. Alternatively, other apparatus may be used to maintain the target deck 212 in a folded configuration, such as tape, a clamp, a hook, etc.

Apertures **226*a* and 226*b* are die cut into target deck 212 so that they are generally alignable when target deck 212 is in a folded configuration. Further, apertures 226*a* and 226*b* are generally alignable with an aperture 232** located in the trigger board.

Preferably, trigger board 230 also includes an alternate stop configuration, such as exemplified by shoulders **238*a* and 238*b* in FIG. 9, which abut portion 216 of target deck 212 to prevent trigger board 230 from sliding completely through aperture 214**.

It is preferred that the target deck, trigger board and target plate are made of cardboard for the embodiments shown in FIGS. 1, 2 and 6–9. It is preferred that the target deck, trigger board and target plate are made of steel for the embodiment shown in FIGS. 3–5.

A method of manufacturing the FIG. 9 embodiment includes the step or steps of die cutting from a sheet of material, such as a single sheet of cardboard, the periphery of target deck 212, apertures 214, **226*a* and 226*b*, tabs 218 and slots 220. Further, at least one fold line (not shown) may be die cut in association with the portion 216 to allow the target deck 212** to be folded.

The trigger board 230 may also be die cut from the same sheet of material. The manufacturing method further includes the step of die cutting the periphery of the trigger board, with or without shoulders **238*a* and 238*b*. Aperture 232 may also be die cut at the same or different step of peripherally die cutting the trigger board 230**.

In the discussed embodiments, the trigger board may have indicia to further signify that the target plate has been accurately struck. For example, a portion of the trigger board may be colored orange. When the target system is in its operative configuration, the colored portion is disposed within the slot of the target deck and hidden from view. When the target plate is struck, the orange portion of the trigger board comes into view to further signify an accurate strike of the target plate.

It should be understood that various modifications, changes, and variations may be made in the details of the invention disclosed herein without departing from the spirit and scope of the invention.

What is claimed:

1. A target system having means for indicating when it has been accurately hit comprising:

a trigger board having at least one aperture;

a target deck having at least another aperture;

a guide associated with the target deck to allow general alignment of the apertures; and at least one target plate configured to fit within the trigger board and target deck apertures when generally aligned to maintain the trigger board and target deck in a fixed relationship, wherein the at least one target plate is capable of complete displacement from both the trigger board and target deck apertures thereby activating the means for indicating when it has been accurately hit.

2. The target system of claim 1 wherein the guide is integral with the target deck.

3. The target system of claim 1 wherein the target plate is attached to the target deck.

4. The target system of claim 1 wherein the target deck and the trigger board are in an overlapping relationship when the target system is in an operative configuration.

5. The target system of claim 4 wherein the target plate is hingedly attached to the target deck.

6. The target system of claim 1 further including a paper target having a designated area and disposed in an overlapping relationship with the target deck such that the at least one target plate is located beneath the designated area.

7. A target system comprising:

a generally flat trigger board defining at least one aperture;

a generally flat target deck defining at least another aperture and configured to allow general alignment of the apertures; and at least one target plate configured to fit within the apertures when generally aligned so that the target deck moves by force of gravity in a predetermined direction relative to the trigger board in response to the trigger plate being completely displaced from within the generally aligned apertures.

8. The target system of claim 7 wherein a contacting projectile penetrates the target plate.

9. The target system of claim 7 wherein the target plate is displaceable from the apertures of the trigger board and target deck by a contacting projectile to allow the projectile through the target system.

10. The target system of claim 7 further including a resistance device associated with the target plate to increase a resistance to a projectile upon contact with the target plate.

11. The target system of claim 7 wherein the target plate is tapered to facilitate the displacement of the target plate from the fit within the generally aligned apertures.

12. The target system of claim 7 wherein the target plate includes an enlarged backing to facilitate the target plate from the fit within the generally aligned apertures.

13. The target system of claim 7 wherein the target plate is generally circular.

14. The target system of claim 7 further including a paper target overlapping the target deck.

15. The target system of claim 14 wherein the paper target has a designation to indicate a location of at least one target plate beneath the paper target.

16. The target system of claim 7 wherein the target deck is provided in the form of a block which defines a longitudinal slot for slidable receipt of the trigger board.

17. The target system of claim 7 further comprising a paper target having a designated area and disposed in an overlapping relationship to the target deck so that the target plate is located beneath the designated area.

18. The target system of claim 7 wherein the trigger board further includes an extended portion which is connectable to a support.

19. A target system comprising:

a trigger board defining at least one aperture;

a target deck defining at least another aperture and configured to define a guide capable of slidably receiving the trigger board to allow general alignment of the apertures; and at least one target plate configured to fit within the apertures when generally aligned to maintain the general alignment of the apertures, wherein the at least one target plate is capable of complete displacement from both the trigger board and target deck apertures.

20. The target system of claim 19 wherein the target deck is movable with respect to the trigger board in response to the target plate being displaced from at least one of the apertures.

21. A target system configured to signify an accurate hit comprising:

a target deck including generally flat front, back, top, bottom and side surfaces that define a block, the block defining a slot which extends longitudinally into the block through the top surface, the block further defining an aperture extending transversely through the front and back surfaces and the block;

a generally flat plate trigger board defining another aperture, the trigger board being slidably receivable within the slot to generally align the trigger board aperture with the target deck aperture; and a target plate configured to fit within the trigger board aperture and the target deck aperture when generally aligned to maintain the target deck and trigger board in a fixed relationship, whereby the trigger board moves within the slot when the target plate is displaced from the trigger board aperture.

22. The target system of claim 21 further comprising a stop configuration.

23. The target system of claim 22 wherein the stop configuration includes shoulders associated with the trigger board.

24. The target system of claim 22 wherein the stop configuration includes a cord fastened to the target deck.

25. The target system of claim 21 wherein the trigger board includes indicia to signify that the target plate has been accurately struck.

26. The target system of claim 21 wherein the target system is resettable.

27. A target system comprising:

a target plate;

a trigger board defining at least one aperture; and a foldable target deck defining an area when folded and at least two apertures wherein the trigger board is slidably received within the area through a one of the at least two apertures, and another of the at least two apertures is generally alignable with the trigger board aperture when the trigger board is received in the area so that the target plate can be removably fitted within all the apertures.

28. The target system of claim 27 wherein the target deck further includes at least one tab and at least one slot wherein the slot receives the tab so that the target deck is maintained in a folded configuration.

29. The target system of claim 27 further comprising a stop configuration.

30. The target system of claim 29 wherein the stop configuration includes shoulders associated with the trigger board to prevent the trigger board from sliding completely through the one of the at least two apertures.

* * * * *